United States Patent [19]

Hiratsuka et al.

[11] Patent Number: 4,797,335

[45] Date of Patent: Jan. 10, 1989

[54] DEVELOPING METHOD FOR ELECTROSTATIC IMAGES USING COMPOSITE COMPONENT DEVELOPER UNDER NON-CONTACTING CONDITIONS

[75] Inventors: Seiichiro Hiratsuka; Satoshi Haneda; Hisashi Shoji, all of Hachioji, Japan

[73] Assignee: Konishiroku Photo Industry Co., Ltd., Tokyo, Japan

[21] Appl. No.: 96,818

[22] Filed: Sep. 10, 1987

Related U.S. Application Data

[63] Continuation of Ser. No. 859,859, May 1, 1986, abandoned, which is a continuation of Ser. No. 634,976, Jul. 27, 1984, abandoned.

[30] Foreign Application Priority Data

Aug. 5, 1983 [JP] Japan ..... 58-142597
Aug. 10, 1983 [JP] Japan ..... 58-145031

[51] Int. Cl.[4] ..... G03G 15/09
[52] U.S. Cl. ..... 430/35; 118/653; 118/657; 355/300; 430/102; 430/122
[58] Field of Search ..... 430/102, 122, 35; 355/300; 118/653, 657

[56] References Cited

U.S. PATENT DOCUMENTS

| | | | |
|---|---|---|---|
| 4,265,197 | 5/1981 | Toyono et al. | 430/122 |
| 4,337,306 | 6/1982 | Kanbe et al. | 430/122 |
| 4,348,979 | 9/1982 | Daintrey | 118/657 X |
| 4,350,749 | 9/1982 | Ohnuma et al. | 430/122 X |
| 4,377,332 | 3/1983 | Tamura | 355/300 |
| 4,383,497 | 5/1984 | Tajima | 118/653 X |
| 4,436,413 | 3/1984 | Oka | 118/657 X |
| 4,444,864 | 4/1984 | Takahashi | 118/653 X |
| 4,450,220 | 5/1984 | Haneda et al. | 430/102 |
| 4,473,627 | 9/1984 | Kanbe et al. | 430/122 X |

FOREIGN PATENT DOCUMENTS

| | | |
|---|---|---|
| 133058 | 10/1980 | Japan . |
| 2028176 | 3/1980 | United Kingdom . |

*Primary Examiner*—Mukund J. Shah
*Attorney, Agent, or Firm*—Jordan B. Bierman

[57] ABSTRACT

A developing method wherein an oscillating electric field is formed in a development area between an image retainer; and a developer feeding carrier of a composite developer containing a chargeable component, and the oscillating waveform of the oscillating electric field is varied to provide an adjustment of the development performance. Preferably, the oscillating electric field is an alternating electric field. The oscillating waveform is modified by varying the amplitude, bias, selection time for a time-selected waveform transformation, or frequency thereof.

12 Claims, 3 Drawing Sheets

DEVELOPING METHOD FOR ELECTROSTATIC IMAGES USING COMPOSITE COMPONENT DEVELOPER UNDER NON-CONTACTING CONDITIONS

This application is a continuation of application Ser. No. 859,859 filed May 1, 1986, now abandoned, which is a continuation of application Ser. No. 634,976 filed 7/27/84, now abandoned.

BACKGROUND OF THE INVENTION

1. Field of the Invention

The present invention relates to a method of developing a latent electrostatic image in an electrostatic recording apparatus such as an electrophotographic reproducing apparatus. In particular, it relates to a developing method wherein an image retainer, on which a latent electrostatic image is formed, faces a developer feeding carrier of a composite developer containing a chargeable component, such as a two-component developer, across a gap between the surfaces thereof. The gap is larger than the thickness of the developer layer, and the latent electrostatic image is developed in this construction.

2. Description of the Prior Art

A composite developer is usually characterized in that the charging of toner particles which contain no magnetic substance is easy to control, because of friction with magnetic carrier particles, and accordingly are easily adsorbed in accordance with the potential of a latent electrostatic image on an image retainer. Therefore, in the method of so-called non-contact jumping development, as described above, wherein toner particles are made to jump from the body conveying and bearing the developer to the image retainer across the gap provided therebetween, the development density is usually adjusted to be constant despite any possible fluctuations in the potential of the latent electrostatic image formed on the image retainer, which are caused by changes in the density of the copy or the discharge potential of a charging electrode, etc., by a method of adjusting the diaphragm of an optical exposure system wherein the latent electrostatic image is formed by exposing an image onto the surface of an image retainer which is uniformly charged, or by a method of adjusting the intensity of a light source. These conventional methods have the problems that a complicated optical exposure system makes the apparatus expensive, and the light source employed is limited to heat-radiating types of light sources such as halogen lamps.

In the method of non-contact jumping development in which a one-component developer consisting mainly of toner particles is used, the charging of the toner particles, which usually contain a magnetic substance, is hard to control because of friction therebetween, and thus a controlling electric field is needed to provide easy control. In order to solve these problems arising in the methods of adjusting the development density as described above, methods wherein the development density was adjusted by varying the amplitude or bias of an oscillating electric field formed in a development area located in the gap between the image retainer and body conveying and bearing the developer have been proposed. Another developing method wherein the development density is adjusted by varying the frequency of an alternating voltage was disclosed in Japanese Patent Laid-Open No. 133058/1980. These methods of adjusting the development density by varying the intensity or frequency of the oscillating electric field are advantageous in that their apparatuses are less expensive than that of the method of varying the diaphragm of an optical system, and in that they are more adaptable than the method of varying the intensity of a light source. However, the method of varying the strength of the oscillating electric field can cause fogging, and the method of varying the frequency is incapable of providing a wide range of variations in development density. Anyway, it is difficult to adjust the development density by these methods to obtain a clear recorded image with fully-reproduced gradations. Furthermore, two different variable voltages are needed for changing the strength of the oscillating electric field in accordance with variations in the potentials of the latent electrostatic image and the background. This causes another problem in that a complicated power source device is needed. The method of varying the frequency requires an even more complicated power source device.

SUMMARY OF THE INVENTION

An object of the present invention is to realize the developing capability of the method of non-contact jumping development using a composite developer, and in particular to vary the development density, while solving the problems of conventional methods of adjusting the development density. The present invention has been developed on the basis of th discovery that the above methods of adjusting development density by varying the amplitude or bias of the oscillating electric field, in a developing method using a one-component developer, also have excellent effects when applied to a developing method using a composite developer, which is based on completely different theories of charging toners and development. As described above, with a onecomponent developer, the toner particles are not sufficiently charged, so a controlling electric field is needed to control them easily. With a composite developer, such as two-component developer, on the other hand, the toner particles are completely charged and are thus easily adsorbed according to the potential of a latent electrostatic image. The employment of the controlling electric field used for a one-component developer could damage the appropriate developing capability of the toner particles. Specifically, it may be considered that the carrier is oscillated and in some cases has a bad influence on the picture image by the change in electric field, because the carrier is charged with a polarity opposite to that of the toner. Further, the carrier and the toner are attracted to each other by Coulomb force, so that only the movement of the toner is obstructed, the fly of the toner embedded in the lower layer of the developer (on the side of the developer feeding carrier) is prevented, and the possibility of contribution to the developing becomes small. Consequently such a controlling electric field has not been used heretofore in the method of non-contact jumping development wherein a two-component developer is employed. The present invention has been achieved by ignoring this preconceived notion of blind spot possessed by people concerned.

In the developing method wherein an image retainer on which latent electrostatic image is formed and a developer feeding carrier of a composite developer containing a chargeable component face each other across a gap between the surfaces thereof which is maintained larger than the thickness of the layer of the developer, and the latent electrostatic image is developed in this construction, the present invention is characterized by a developing method wherein an oscillating electric field is formed in a development area located within the gap between the surfaces, and the oscillating waveform of the oscillating electric field is made variable so that the developing performance can be adjusted. Because of this characteristic feature, the present invention has achieved the object of an efficient adjustment of development density without affecting the developing capability of the toner particles of the composite developer, and provides images of a superior clarity than those obtained by using a one-component developer.

Another object of the present invention is to provide a developing method which enables adjustment of the development density so as to make it possible to obtain clear recorded images with satisfactorily reproduced gradations, using an oscillating electric field applied to the development area, and also a relatively simply-constructed power source device.

In a developing method wherein an oscillating electric field is generated in the development area by a periodic voltage, and a latent electrostatic image on an image retainer is developed with a toner in that development area, the present invention provides a developing method characterized in that a selection time of the periodic voltage is adjustable, and the above objects are achieved by this construction.

Other objects and characteristics of the present invention will be described below with reference to drawings.

DESCRIPTION OF THE PREFERRED EMBODIMENTS

Figure 1:
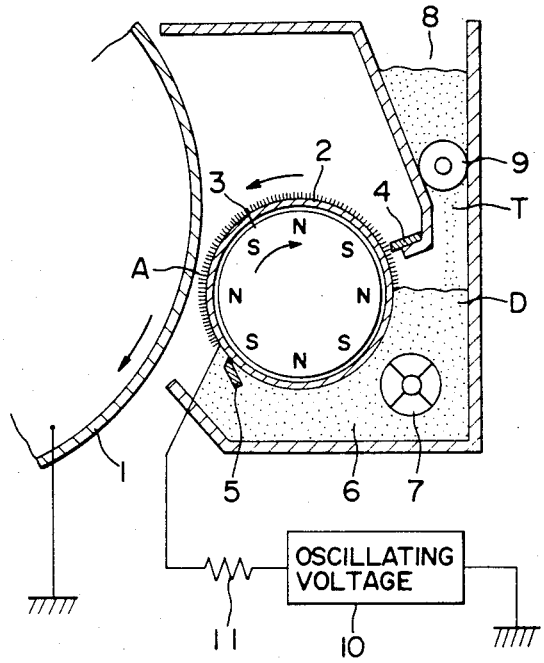
FIG. 1 shows schematically the construction of a typical developing apparatus wherein the method of the present invention is embodied.
Figure 2:
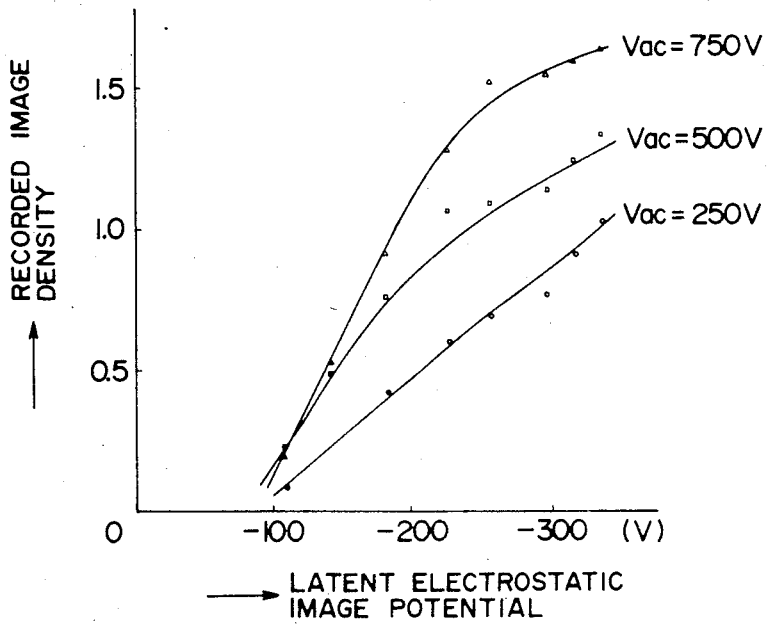
FIG. 2 is a graph of the relationship between the potential of a latent electrostatic image and the density of the recorded image obtained when the amplitude of an oscillating electric field is varied.

FIG. 1 shows the construction of one example of a developing apparatus wherein the method of the present invention is embodied, and FIG. 2 is a graph of the relationship between the potential of a latent electrostatic image and the density of the recorded image obtained when the amplitude of an oscillating electric field is varied.

In FIG. 1, numeral 1 denotes a drum-shaped image retainer rotating in the direction of the arrow and which has, on the surface thereof, a layer of an electrophotographic photosensitive substance or a dielectric on which a latent electrostatic image can be formed by a charging and exposing device or an electrostatic latent image-forming device using multistylus electrodes or ion-controlling electrodes, which is not shown in the figure, but is known publicly. Numeral 2 denotes a developer sleeve made of a nonmagnetic material such as aluminum, and 3 a magnetic body provided within the developer sleeve 2 and which has a plurality of N and S magnetic poles aligned circumferentially on the surface thereof. The developer sleeve 2 and the magnetic body 3 constitute a body for conveying and bearing a developer. The developer sleeve 2 and the magnetic body 3 can rotate relative to each other. In the figure, that the developer sleeve 2 can rotate counterclockwise and the magnetic body 3 clockwise. The N and S magnetic poles of the magnetic body are usually magnetized to a magnetic flux density of between 500 to 1,500 Gauss, and the magnetic force thereof attracts a developer layer D composed of toner particles which can be charged by friction and magnetic carrier particles onto the surface of the developer sleeve 2 so that it forms what is called a magnetic brush. It is preferable that the weight-averaged particle size of the toner particles in the developer D is between 3 to 30 μm, and that of the magnetic carrier particles thereof is between 5 to 50 μm, and also the magnetic carrier particles are preferably formed of an insulating resin containing minute magnetic particles dispersed therein. The magnetic brush moves in the same direction as the rotation of the developer sleeve 2 and the magnetic body 3 rotate as described above, and is conveyed onto a development area A in which the surfaces of the image retainer 1 and the developer sleeve 2 face each other.

Numeral 4 denotes a thickness-regulating blade made of a magnetic or nonmagnetic substance which regulates the height and quantity of the magnetic brush on the surface of the developer sleeve 2, and the gap between the surfaces of the image retainer 1 and the developer sleeve 2 is set to be larger than the thickness of the regulated magnetic brush; namely, at an appropriate distance sufficient to prevent the magnetic brush touching the surface of the image retainer 1 and enabling the so-called noncontact jumping development wherein the toner particles fly from the magnetic brush and stick onto a latent electrostatic image on the image retainer 1. It is preferable that the gap between the surfaces of the image retainer 1 and the developer sleeve 2 is between 0.3 to 1.5 mm and the thickness of the magnetic brush between 0.1 to 0.5 mm, so that a gap of between 0.1 to 1 mm is formed between the magnetic brush and the surface of the image retainer 1.

Numeral 5 denotes a cleaning blade which removes the magnetic brush which has passed through the development area A from the surface of the developer sleeve 2, 6 denotes a reservoir of developer, 7 denotes an agitator screw which agitates the developer D in the reservoir 6 to make the mixture of toner particles and carrier particles uniform, 8 denotes a toner hopper which supplies the toner particles T, 9 denotes a toner-supplying roller which has a concavity on the surface thereof and operates to drop the toner particles T into the reservoir 6 of developer, and 10 denotes an oscillation power source which applies a voltage which has an oscillating component onto the developer sleeve 2 through a protective resistor 11 so that an oscillating electric field is formed in the development area A. The oscillation power source 10 is able to deliver voltages of different oscillating waveforms which are obtained by varying one or more of the amplitude of the alternating-current voltage or a pulse voltage, the bias due to the direct-current voltage component, a selection time in a time-selected waveform transformation, frequency, etc. The density of the recorded image, i.e. the density of the development, can be adjusted by varying the oscillating waveform of the oscillating electric field formed in the development area A by this power source, as shown in FIG. 2.

FIG. 2 shows the results of developing performed under conditions such that the oscillation power source 10 of FIG. 1 delivered an oscillating voltage obtained by superimposing an alternatingcurrent voltage of 1 KHz of various amplitudes on a direct-current bias voltage of −150V; the layer of the image retainer 1 whereon a latent electrostatic image is formed comprised a charge-generating layer and a charge-carrying layer formed of an organic photoconductor OPC, and the surface speed of the layer in the direction of the arrow was 120 mm/sec; the gap between the image retainer 1 and the developer sleeve 2, i.e. the gap within the development area A, was 700 μm; the developer sleeve had an outer diameter of 30 mm and a rotational speed of 65 r.p.m. in the direction of the arrow, the gap between the thicknessregulating blade 4 formed of a magnetic substance and the developer sleeve 2 was 300 μm; the rotational speed in the direction of the arrow of the magnetic body 3, which had eight N and S magnetic poles of a magnetic denstiy 900 Gauss aligned at equal intervals, was 700 r.p.m.; and the magnetic brush formed on the developer sleeve 2 by using as the developer D a two-component developer (EP 310 developer manufactured by Minolta Co., Ltd.), which consisted of an insulating magnetic carrier of a weight-averaged particle size of about 30 μm which contained a powder of a magnetic substance in resin and which had a resistivity of about $1\times10^{14}\ \Omega$ cm, and an insulating nonmagnetic toner of a weight-averaged particle size of 14 μm, had about 200 μm as a gap between the image retainer and the top of said developer layer. The density of the recorded image indicated along the ordinate was the density of an image obtained by transferring the developed toner image onto recording paper by a transfer device (not shown in FIG. 1) and then fixing the transferred toner image thereon by a fixing device. This density corresponds to the development density. $V_{ac}$ for each density curve was the effective value of the AC voltage component output from the oscillation power source 10, while the potential of the background portion of the latent elecrostatic image, i.e., the potential of the nonimage portion thereof, was −50V.

As is apparent from FIG. 2, the development density can be adjusted to make the density of the recorded image constant by varying the amplitude of the oscillating electric field formed in the developement area, even when a variation of more than 100V occurs in the potential of the latent electrostatic image.

For the oscillating electric field, it is preferable to apply an oscillating voltage with an AC voltage component of an effective value of between 200 and 5,000V, to generate an electric field intensity of an effective value of between 300 and 3,000 V/mm.

The present invention is not limited to the example of FIG. 2 wherein amplitude is varied. The adjustment can also be performed by varying the level of the DC bias voltage superimposed onto the AC voltage component while varying the amplitude simultaneously, or while keeping it constant. A pulsed voltage can be used instead of the AC voltage, or the oscillating waveform can be varied by either a time-selected transformation or by varying the frequency. When the frequency is varied, the development density and the density of the recorded image drops as the frequency increases if the frequency exceeds 2 KHz. Therefore, it is advisable the developement density be adjusted by varying the frequency below the limit of 2 KHz. The preferable frequency range is 0.3 to 5 KHz.

The present invention provides the effect that recorded images with excellent gradations can be reproduced by a simple adjustment of the development density using a relatively simple apparatus, even when using a developing method which employs composite developer of which charging is easier to control than a one-component developer, and it also provides the very satisfactory result that adjustment of the density of the recorded image can be performed with a better reproducibility of gradations than when using a one-component developer.

Figure 3:
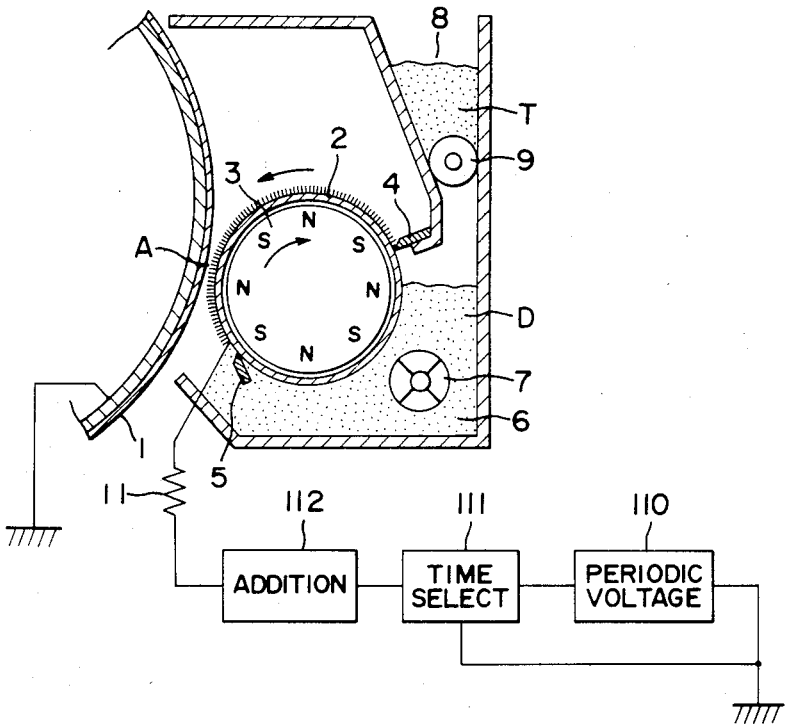
FIG. 3 shows schematically the construction of a developing apparatus which is another embodiment of the present invention.
Figure 4:
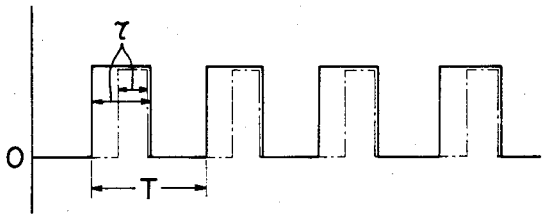
FIGS. 4 to 6 are waveform diagrams of examples of periodic voltages used in the present invention.
Figure 5:
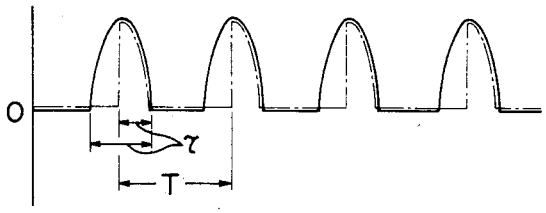
Figure 6:
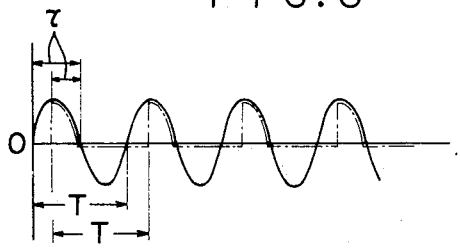
Figure 7:
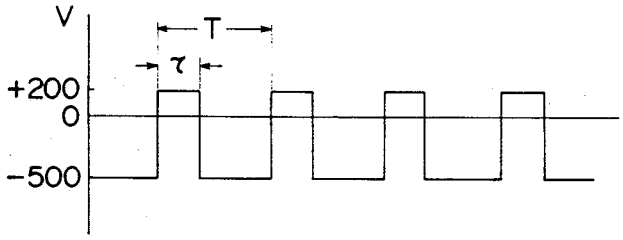
FIGS. 7 and 8 are waveform diagrams of examples of oscillating voltage applied on a developer sleeve.
Figure 8:
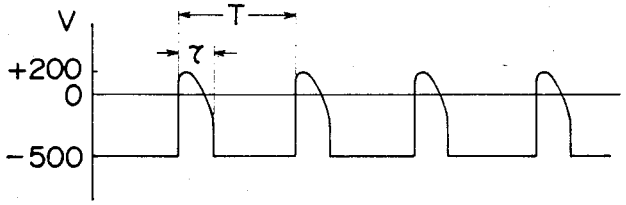

FIG. 3 shows a schematic construction of another embodiment of the developing apparatus to which the method of the present invention is applied; FIGS. 4 to 6 are waveform diagrams of examples of periodic-wave voltages employed in the present invention; FIGS. 7 and 8 are waveform diagrams of examples of oscillating voltages applied on the developer sleeve; and FIG. 9 is a graph of the relationship between the potential of a latent electrostatic image and the density of the recorded image obtained when the time selected for a waveform transformation is varied.

In FIG. 3, the same elements as those in FIG. 1 are indicated by the same numerals and marks. In this figure, numeral 110 denotes a periodic-voltage generating circuit which generates a periodic voltage such as those indicated by the solid lines in Figures 4 to 6; and 111 denotes a time-selecting circuit which transforms the waveform output from the periodicvoltage generating circuit 110 into the forms indicated by the dot-dash lines in FIGS. 4 to 6, or which further amplifies them; while 112 denotes an addition circuit which superimposes a DC bias voltage onto the output from the time-selecting circuit 111 to convert it into an oscillating voltage such as those shown in FIGS. 7 and 8. The output of this addition circuit 112 is applied on the developer sleeve 2 through the protective resistor 11, so that an oscillating electric field is generated in the development area A between the image retainer 1 whose conductive base is grounded and the developer sleeve 2. The oscillating voltage of FIG. 7 is obtained by a time-selected transformation of the waveform of FIG. 4 and a superimposition of a DC bias voltage, while the oscillating voltage of FIG. 8 is obtained by a time-selected transformation of the waveform of FIG. 5 or FIG. 6 and a superimposition of a DC bias voltage.

Figure 9:
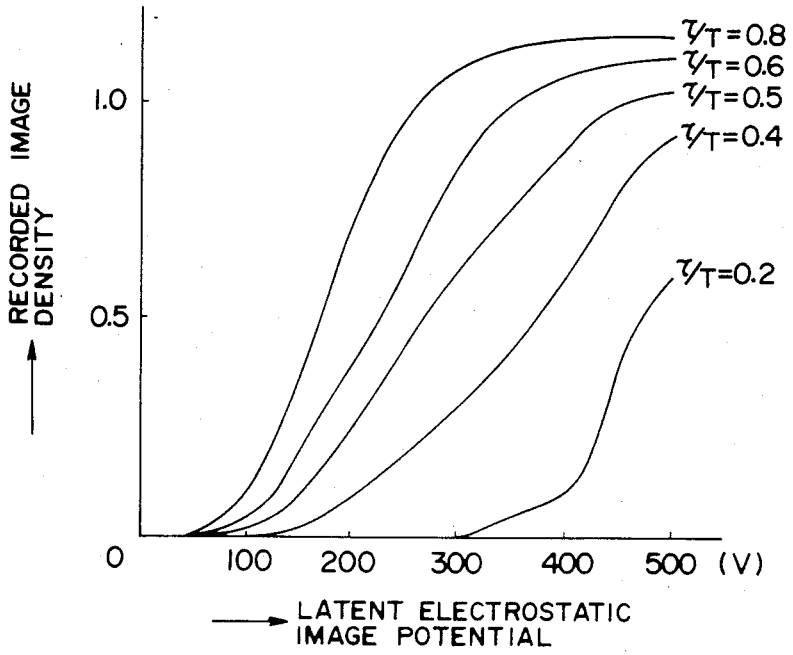
FIG. 9 is a graph of the relationship between the potential of the latent electrostatic image and the density of the recorded image obtained when the selection time of a variable waveform is changed.

In this developer apparatus, different density curves of the recorded image, as shown in FIG. 9, are obtained by varying the $\tau/T$ ratio of the oscillating voltage when latent electrostatic images of various potentials are developed by applying onto the developer sleeve 2 an oscillating voltage of a period T of 2 msec, as shown in FIG. 7, under conditions such that the latent electrostatic image layer on the image retainer 1 comprised a charge-generating layer and a charge-carrying layer formed of an organic photoconductor OPC, and the surface speed of the layer in the direction of the arrow was 120 mm/sec; the gap between the image retainer 1 and the developer sleeve 2, i.e., the gap within the development area A, was 750 μm; the developer sleeve 2 had an outer diameter of 30 mm and a rotational speed of 65 r.p.m.; the gap between the thickness-regulating blade 4 formed of a nonmagnetic substance and the developer sleeve 2 was 350 μm; the rotational speed in the direction of the arrow of the magnetic body 3, which has eight N and S magnetic poles of a magnetic density of 900 Gauss aligned at equal intervals, was 700 r.p.m.; and a two-component developer (EP 310 developer manufactured by Minolta Co., Ltd.), which consisted of an insulating magnetic carrier of a weight-averaged particle size of about 30 μm containing a powder of a magnetic substance in resin, and which has a resistivity of about $1\times10^{14}$ Ω cm, and an insulating nonmagnetic toner of a weight-averaged particle size of 14 μm, was used as the developer D.

The development in this case was performed by the method of so-called non-contact jumping development, wherein toner particles fly from the magnetic brush onto the surface of the image retainer 1, but the magnetic brush itself, formed on the developer sleeve 2, does not touch the surface of the image retainer 1. The density of the recorded image was the density of an image obtained by transferring the develpoed toner image onto recording paper by a transfer device (not shown in the figure), and then fixing the toner image thus transferred by a fixing device. Recorded-image density curves similar to those of FIG. 9 can be obtained when the development is carried out in the presence of the oscillating voltage of FIG. 8.

As is apparent from FIG. 9, the density of the recorded image, i.e., the development density, can be adjusted to be constant by varying the $\tau/T$ ratio alone, without varying the amplitude or bias of the oscillating voltage or the frequency thereof, even when the potential of the latent electrostatic image varies by about 300V. This method of adjustment reduces the possibility of fogging, since neither the amplitude nor the bias is varied, and consequently a clear recorded image with an excellent gradation reproducibility can be obtained with ease.

The present invention is not limited to the examples described above. The waveform of the oscillating voltage can be any periodic waveform instead of the rectangular waveform of FIG. 4, the halfwave rectification sine waveform of FIG. 5 or the sine waveform of FIG. 6. An oscillating voltage whose waveform is transformed in the time-selecting circuit, but which is not subjected to DC bias conversion, may also be employed. Moreover, although the waveform transformation is conducted by a time-selecting circuit in the example described above, the waveform transformation means is not limited thereto, and a voltage which is time-selected by a pulse-generating source could be used for this purpose. This would mean that the structure of the pulse-generating source could be made simple, and the present invention is also effective in this case. The oscillating electric field may also be generated in the development area by applying an oscillating voltage on a wire-shaped or grid-shaped control electrode provide between the image retainer 1 and the developer sleeve 2 in such a manner that it does not hinder the flight of toner from the magnetic brush onto the latent electrostatic image.

The application of the method of non-contact jumping development wherein a two-component developer composed of a toner and a carrier (preferably insulating, and of weight-average particle size 40μ or less) is used as the developer, as in the above embodiments, is preferable to secure a sufficient adjustment with an excellent gradation reproducibility, to obtain thereby a clear recorded image.

In the present invention, alteration of the selection time for varying the $\tau/T$ ratio could, of course, be performed manually, or it could be automated with ease by utilizing a computer or other means, based on the detection of the potential of the latent electrostatic image and the density of the toner image, etc.

As described above, the present invention development density to be adjusted within a wide range with a reduced possibility of fogging by an alteration of the selection time of the time-selected transformation, and thus a clear recorded image with an excellent gradation reproducibility can be obtained, and a power source device therefor can be constructed relatively simply.

Further, according to the present invention, the quantity of the toner attached to the latent image and the gradation can be controlled by varying the frequency. Accordingly, the developing capability can be maintained best even if the developer has deteriorated and the developing property varies due to the change in humidity of environment.

The present invention can be attained by using a method wherein the frequency of a rectangular wave or other waves is varied, other than a method wherein the frequency of a sine wave alternating current is varied. The developing capability can be controlled by varying the duty ratio in case of the voltage of the rectangular wave etc. There is a merit in case of the rectangular wave. Specifically, the duty of voltage forming an electric field which is impressed on the toner is not varied even if the threshold bias voltage at which the toner is flown with two-component jumping or the crest value of the rectangular wave itself is varied, because in case of the rectangular wave both the frequency and the duty can be used.

It may be possible to control effectively the developing capability by thinning some pulses among the pulses within a predetermined time, instead of varying said duty ratio.

What is claimed is:

1. In a developing method wherein an image retainer, on which a latent electrostatic image is formed, and a developer feeding carrier of a composite developer, which comprises a toner and a carrier and contains a chargeable component, face each other across a gap formed between the surfaces thereof which is larger than the thickness of the layer of said developer, said latent electrostatic image being developed in this construction, the improvement which comprises an oscillating electric field formed in a development area wherein said gap is maintained, the oscillating waveform of said oscillating electric field being variable automatically based on the detection of a potential of the latent electrostatic image formed on said image retainer to provide a control of a density of the developed image.

2. The developing method of claim 1 wherein the particle size of said carrier is between 5 to 50 μm and the particle size of said toner is between 3 to 30 μm.

3. In a developing method wherein an image retainer, on which a latent electrostatic image is formed, and a developer feeding carrier of a composite developer, which comprises a toner and a carrier and contains a chargeable component, face each other across a gap formed between the surfaces thereof which is larger than the thickness of the layer of said developer, said latent electrostatic image being developed in this construction, the improvement which comprises an oscillating electric field formed in a development area wherein said gap is maintained, the oscillating waveform of said oscillating electric field being variable automatically based on the detection of a density of the developed image formed on said image retainer to provide a control of a density of the developed image.

4. The developing method of claim 3 wherein said oscillating electric field is an alternating electric field.

5. The developing method of claim 3 wherein said oscillating waveform is modified by varying any of the amplitude, bias, selection time for a time-selected waveform transformation, or frequency thereof.

6. The developing method of claim 3 wherein a time with which a periodic voltage is selected is varied.

7. The developing method of claim 6 wherein a voltage obtained by superimposing a direct-current voltage onto said periodic voltage is used for forming said oscillating electric field.

8. The developing method of claim 3 wherein the particle size of said carrier is between 5 to 50 μm and the particle size of said toner is between 3 to 30 μm.

9. The developing method of claim 1 wherein said oscillating electric field is an alternating electric field.

10. The developing method of claim 1 wherein said oscillating waveform is modified by varying any of the amplitude, bias, selection time for a time-selected waveform transformation, or frequency thereof.

11. The developing method of claim 1 wherein a time with which a periodic voltage is selected is varied.

12. The developing method of claim 11 wherein a voltage obtained by superimposing a direct-current voltage onto said periodic voltage is used for forming said oscillating electric field.

* * * * *